US011515082B2

(12) United States Patent
Park

(10) Patent No.: US 11,515,082 B2
(45) Date of Patent: Nov. 29, 2022

(54) METHOD FOR PRODUCING ELECTRICITY USING INDUCTIVE ELECTROMAGNETIC FORCE OF POWER GENERATION COIL

(71) Applicant: Sun Mi Park, Jeollanam-do (KR)

(72) Inventor: Sun Mi Park, Jeollanam-do (KR)

( * ) Notice: Subject to any disclaimer, the term of this patent is extended or adjusted under 35 U.S.C. 154(b) by 621 days.

(21) Appl. No.: 16/607,090

(22) PCT Filed: Apr. 25, 2018

(86) PCT No.: PCT/KR2018/004778
§ 371 (c)(1),
(2) Date: Oct. 21, 2019

(87) PCT Pub. No.: WO2018/199612
PCT Pub. Date: Nov. 1, 2018

(65) Prior Publication Data

US 2020/0381174 A1 Dec. 3, 2020

(30) Foreign Application Priority Data

Apr. 28, 2017 (KR) ..... 10-2017-0054995

(51) Int. Cl.
*H01F 27/38* (2006.01)
*H01F 3/10* (2006.01)
*H01F 30/06* (2006.01)

(52) U.S. Cl.
CPC ..... *H01F 27/38* (2013.01); *H01F 3/10* (2013.01); *H01F 30/06* (2013.01)

(58) Field of Classification Search
CPC . H01F 27/38; H01F 3/10; H01F 30/06; H01F 27/24; H01F 27/28; H01F 38/14; H02N 11/002
See application file for complete search history.

(56) References Cited

U.S. PATENT DOCUMENTS 7,148,782 B2 * 12/2006 Hirzel ..... H01F 27/306 336/212
10,796,845 B2 * 10/2020 Zannol ..... H01F 41/0233
(Continued)

FOREIGN PATENT DOCUMENTS

KR 10-2002-0093442 A 12/2002
KR 10-2009-0056457 A 6/2009
KR 10-2014-0066837 A 6/2014

*Primary Examiner* — Tuyen T Nguyen
(74) *Attorney, Agent, or Firm* — KORUS Patent, LLC; Seong Il Jeong

(57) ABSTRACT

The present invention is directed to a method for producing induced electricity which prevents a collision by guiding induced electromagnetic force generated from a power generation coil as electricity is produced in the power generation coil to a predetermined location deviating from the path of power generation magnetic force which proceeds to be interlinked with the power generation coil to thus prevent power generation resistance from occurring and also produces electricity by interlinking the induced electromagnetic force with the power generation coil. The present invention is also directed to a "method for producing electricity using the induced electromagnetic force of a power generation coil" which uses an energy source for the production of electricity without conversion, so that there are no loss of energy during an energy conversion process and maintenance and management are easy, thereby reducing costs.

4 Claims, 6 Drawing Sheets

(56) References Cited

U.S. PATENT DOCUMENTS

| | | | |
|---|---|---|---|
| 2003/0020579 | A1 | 1/2003 | Ngo et al. |
| 2009/0127938 | A1 | 5/2009 | Sahin et al. |

* cited by examiner (D)

(C)

(F)

(E)

(K)

(L)

METHOD FOR PRODUCING ELECTRICITY USING INDUCTIVE ELECTROMAGNETIC FORCE OF POWER GENERATION COIL

TECHNICAL FIELD

The present invention relates to a power generation apparatus which produces electricity by interlinking (passing) power generation magnetic force with (through) a power generation coil, and more specifically to a method which guides "induced electromagnetic force," which is generated from a power generation coil as electricity is produced and acts as resistance impeding the progress of power generation magnetic force which proceeds to be interlinked with the power generation coil, to a predetermined location deviating from the path of the power generation magnetic force to thus prevent a collision between the power generation magnetic force and the induced electromagnetic force and also produces electricity by using the induced electromagnetic force as power generation magnetic force.

BACKGROUND ART

So far, as a method for producing electricity by interlinking varying magnetic force with a power generation coil, there has been chiefly used a method in which a rotating shaft is disposed at the center, a predetermined number of power generation field magnets corresponding to a design are disposed on the outer surface of the rotating shaft, iron cores on which power generation coils are wound are disposed a predetermined distance away from the rotation path of the power generation field magnets, and the generation of electromagnetism is induced in the power generation coils by interlinking varying magnetic force with the power generation coils by using a method of selectively allowing the power generation field magnets to selectively face and be separated from the iron core by rotating the rotating shaft using power, thereby producing electricity. On the other hand, for the purpose of manipulating the voltage of electricity, electricity in which voltage changes according to the ratio of the lengths of a primary coil and a secondary coil has been produced and used by using a method in which an excitation (primary) coil and power generation (secondary) coils having different diameters are disposed at both ends of a magnetic force conductor composed of a magnetic body having a closed structure and varying magnetic force is generated in the excitation (primary) coil by applying varying electricity to the wound excitation (primary) coil and is interlinked with the power generation (secondary) coils by using the magnetic force conductor.

However, when the power generation field magnets are rotated to produce electricity, the magnetic force of the power generation coil core and the power generation field magnets cause reactive repulsive and attractive forces and these forces act as resistance which impedes the rotation of the rotation shaft. Furthermore, in order to obtain rotational power using fossil fuel, such as coal or oil, or nuclear power as an energy source, it is necessary to convert the energy source into power (steam) using a power generating device such as a boiler, to convert the generated power into rotation energy using a rotation generating device (turbine) and to rotate a rotation shaft. In the case of using new renewable energy, such as tidal power, hydropower, wind power, or the like, as an energy source, equipment having a complex structure needs to be used to obtain new renewable energy and convert the obtained energy into usable rotational energy. Therefore, a problem arises in that a large cost is required to manufacture and install the equipment.

Furthermore, problems arise in that energy loss occurs due to heat dissipation and mechanical friction during an energy conversion process, energy usage efficiency is lowered, contamination, such as a harmful material, noise, etc., occurs, and maintenance and management are expensive.

When electricity is produced by interlinking the magnetic force, generated by applying electricity to the excitation (primary) coil, with the power generation (secondary) coil, electromagnetic force induced by produced current is generated in the power generation coil as the magnetic force is interlinked with the power generation (secondary) coil and electricity is produced, the induced electromagnetic force generates magnetic force having the same polarity as magnetic force proceeding to be interlinked with a (secondary) coil on a power generation coil surface, and thus acts as resistant which impedes the process of the magnetic force, thereby causing problems in which power generation magnetic force is lost and power generation efficiency is lowered.

DISCLOSURE

Technical Problem

The present invention has been conceived to overcome the above-described problems, and an object of the present invention is to provide a novel "method for producing electricity using the induced electromagnetic force of a power generation coil" which does not require a device having a complex structure used for the acquisition or conversion of energy because it uses an energy source directly for power generation without conversion, unlike in the case of using fossil fuel, nuclear power, new renewable energy, or the like as an energy source, so that a structure for the method is simple, and thus manufacturing and installation costs are inexpensive.

Another object of the present invention is to provide a novel "method for producing electricity using the induced electromagnetic force of a power generation coil" which uses an energy source for the production of electricity without conversion, so that there are no occurrence of resistance between a power generation field magnet and an iron core, no loss of energy during an energy conversion process and no occurrence of contamination such as a harmful material, noise, etc., and maintenance and management are easy, thereby reducing costs.

Still another object of the present invention is to provide a novel "method for producing electricity using the induced electromagnetic force of a power generation coil" which prevents the loss of magnetic force by guiding induced electromagnetic force generated from a power generation (secondary) coil as electricity is produced in the power generation (secondary) coil to a predetermined location deviating from the path of power generation magnetic force which proceeds to be interlinked with the power generation (secondary) coil to thus prevent induction resistance from occurring and also produces electricity by interlinking the induced electromagnetic force with the power generation coil, thereby increasing power generation efficiency.

Technical Solution

In order to accomplish the above objects, the present invention provides a "method for producing electricity using the induced electromagnetic force of a power generation coil," the method including:

an excitation core (12) which is constructed by winding an excitation coil (11) and a power generation coil (13) on both sides of a magnetic force guidance unit (31) configured to form a closed circuit and to absorb magnetic force and form lines of magnetic force 41; power generation cores 22 which are each constructed by winding a power generation coil (23) on one side of a magnetic force guidance unit (31-1) configured to form a closed circuit and to a absorb induced electromagnetic force (43, and 43-1) and form lines of magnetic force (41-1); and a power generation cell (52) which is constructed by stacking and coupling the excitation core and the power generation cores;

a power generation module (53) which is constructed by stacking a predetermined number of power generation cells (52) in upward and downward directions;

a controller (40) which controls and manipulates input and output of electricity; and a housing (51) which accommodates and holds components.

Advantageous Effects

The "method for producing electricity using the induced electromagnetic force of a power generation coil" according to the present invention does not require an energy conversion device, unlike power generation using fossil fuel, nuclear power, new renewable energy, or the like, so that manufacturing and installation costs are inexpensive and management is easy because a structure for the method is simple, so that there is no occurrence of contamination such as a harmful material, noise, etc., so that there is no loss of energy during an energy conversion process, so that there is no loss of magnetic force because there is no resistance which impedes the progress of power generation magnetic force which proceeds to be interlinked with the power generation coil, unlike in the case of producing electricity using different voltages, so that energy efficiency is high because electricity is produced using induced electromagnetic force as power generation magnetic force.

BEST MODE

Embodiments of a "method for producing electricity using the induced electromagnetic force of a power generation coil" according to the present invention will be described in detail below with reference to the accompanying drawings.

Figure 1:
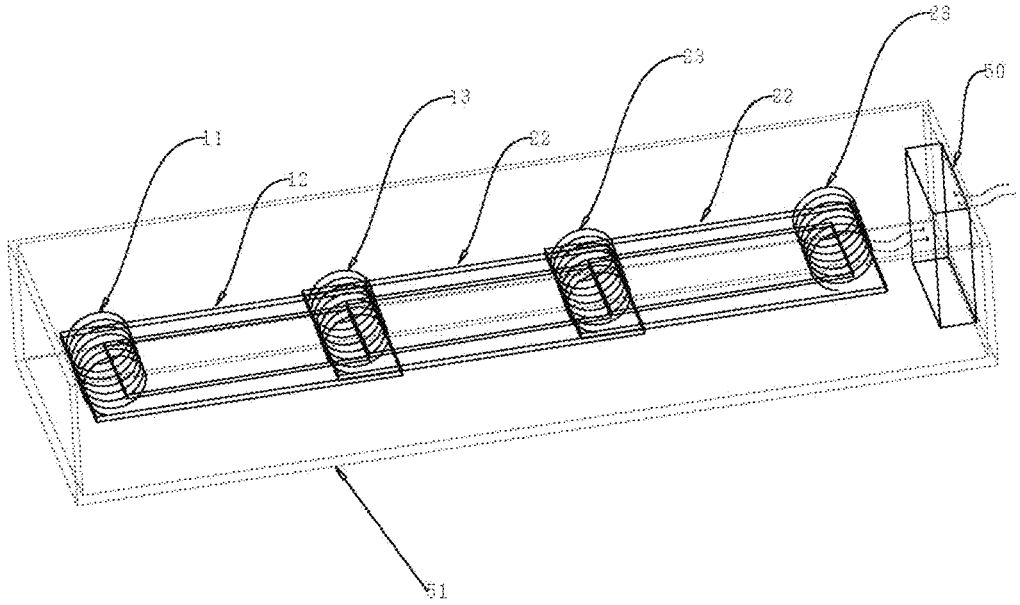
FIG. 1 is a diagram showing an example of the configuration of the present invention.
Figure 2:
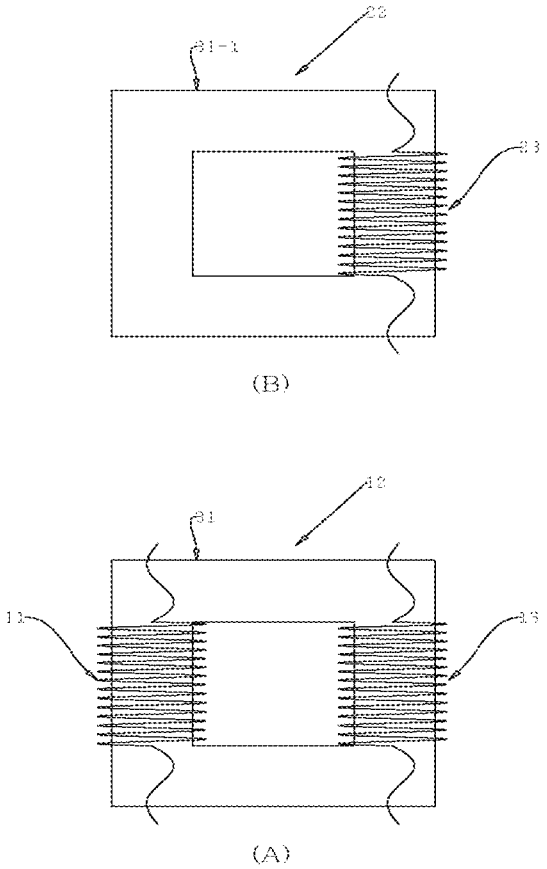
FIG. 2 shows diagrams depicting an example of the configuration of an excitation core and an example of the configuration of a power generation core according to the present invention.
Figure 3:
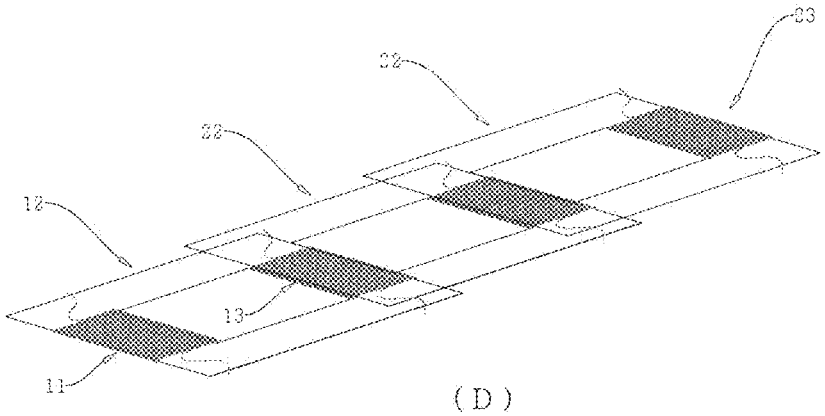
FIG. 3 shows diagrams depicting examples of the configuration of power generation cells according to the present invention.
Figure 3:
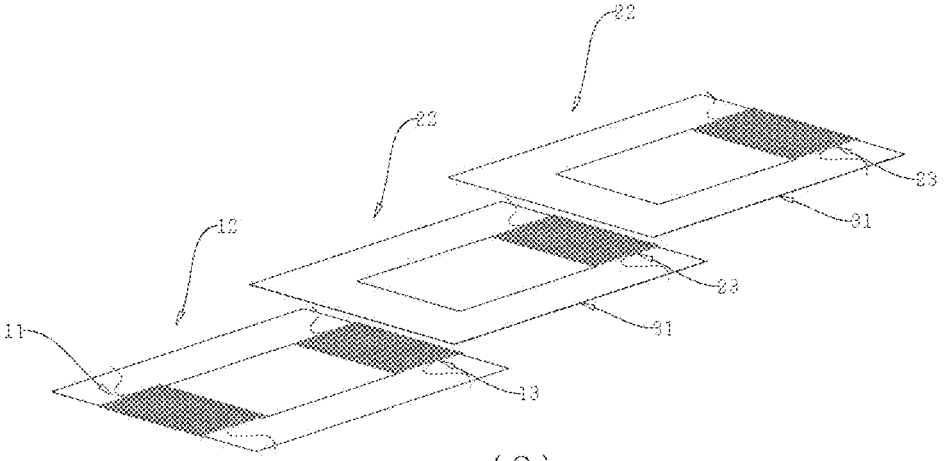
Figure 4:
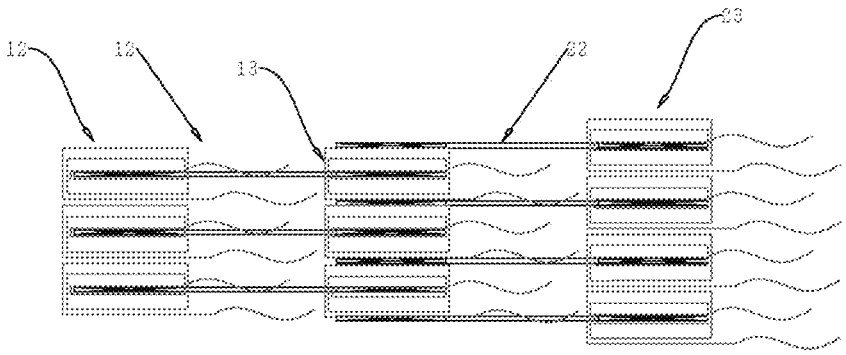
FIG. 4 shows diagrams depicting an example of the configuration of a power generation module according to the present invention.
Figure 4:
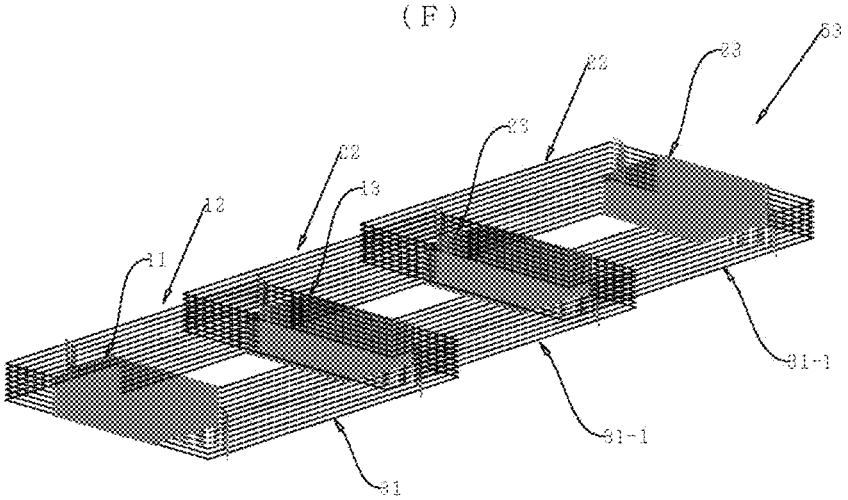

FIG. 1 is a diagram showing the configuration of the present invention, FIG. 2 shows diagrams depicting an excitation core 12 and a power generation core 22 according to the present invention, wherein FIG. 2(A) is a view showing the configuration of the excitation core and FIG. 2(B) is a view showing the configuration of the power generation core, FIG. 3 shows diagrams illustrating the configuration of a power generation cell 52 according to the present invention, wherein FIGS. 3(C) and 3(D) are views the processes of stacking an excitation core 11 and a power generation core 22, and FIG. 4 shows diagrams depicting the configuration of a power generation module 53, wherein FIGS. 4(E) and 4(F) are views showing the power generation module 53 into which power generation cells 52 are combined.

Figure 5:
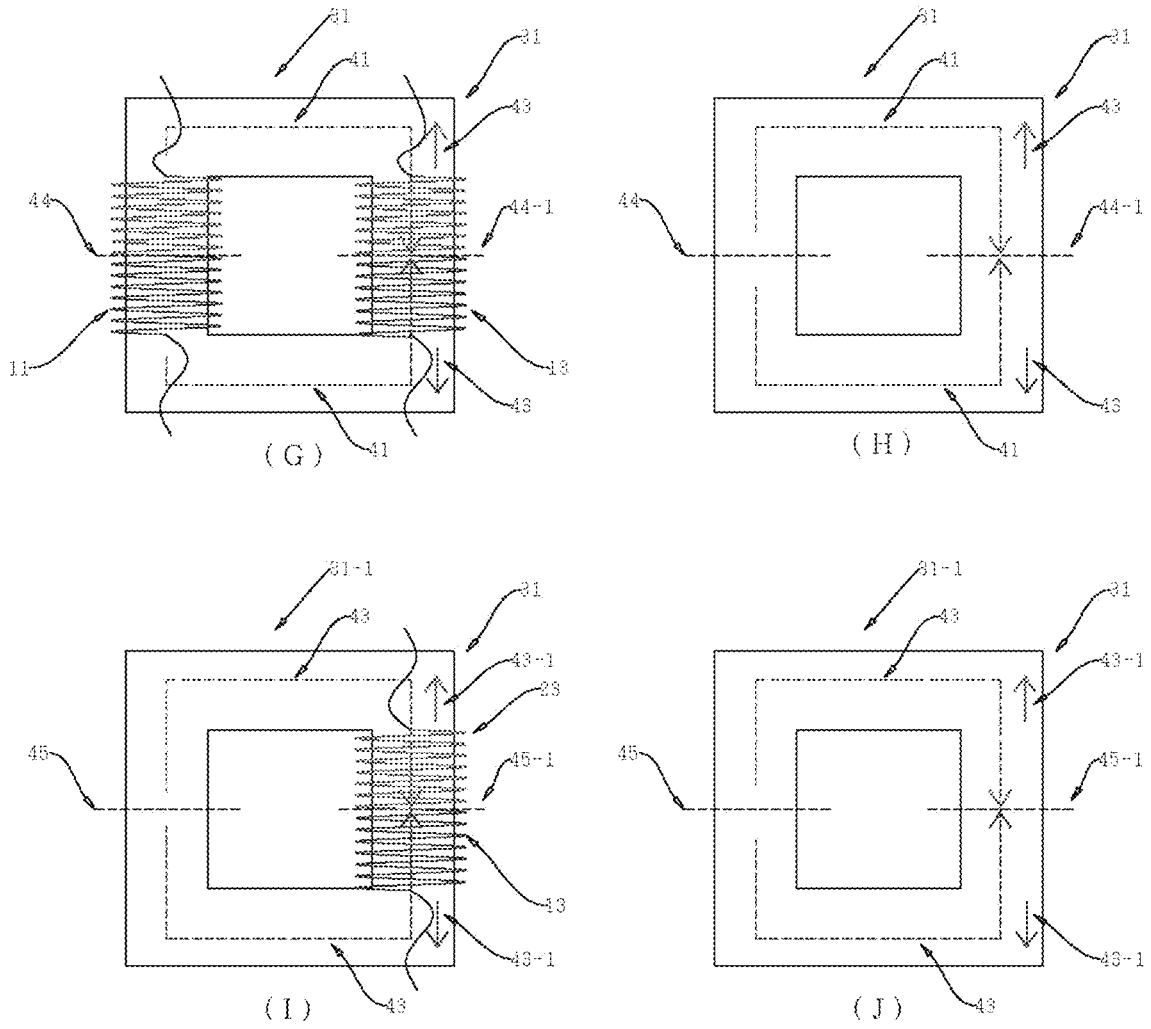
FIG. 5 shows diagrams depicting the generation and flows of magnetic force and induced electromagnetic force according to the present invention.
Figure 6:
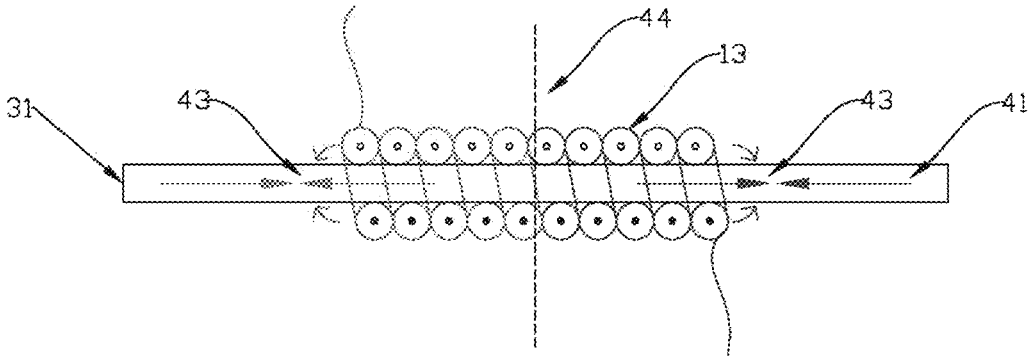
FIG. 6 shows diagrams depicting the interaction between magnetic force and induced electromagnetic force according to the present invention.
Figure 6:
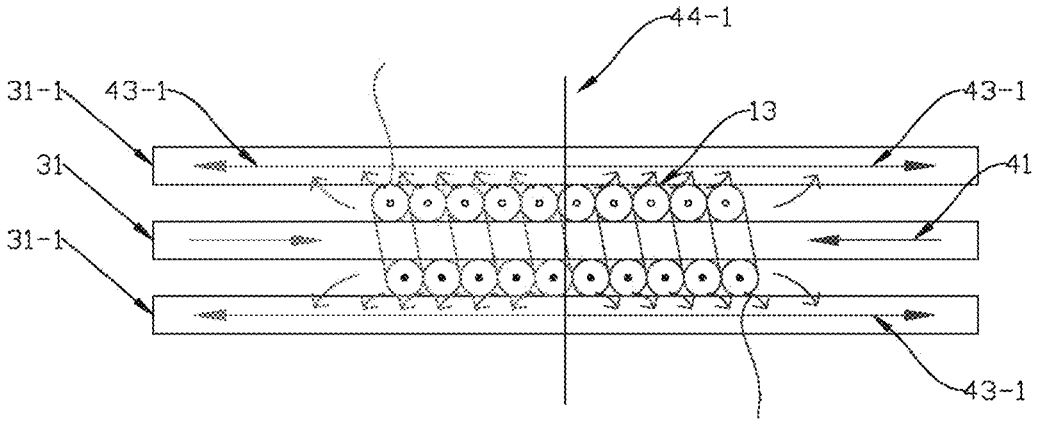

Furthermore, FIG. 5 shows diagrams illustrating the operations of the excitation core 12 and the power generation core 22 attributable to the input of electricity according to the present invention, wherein FIGS. 5(G) and 5(H) are views showing the progress of magnetic force 41 generated by the excitation coil 11 to which electricity is applied and the progress of induced electromagnetic force 43 generated by a power generation coil 13 and FIGS. 5(I) and 5(J) are view illustrating the progress of induced electromagnetic force 43-1 generated by the power generation coil when the induced electromagnetic force 43 generated by the power generation coil 13 is induced to a magnetic force guidance unit 31-1 and interlinked with the power generation coil 23. Moreover, FIG. 6 shows diagrams depicting the progress of magnetic force interlinked with the power generation coil according to the present invention, the progress of induced electromagnetic force generated by the power generation coil, and the interaction between the magnetic force and the induced electromagnetic force, wherein FIG. 6(K) is a view showing an example of the progress of the induced electromagnetic force 43 generated when the magnetic force 41 of the excitation core is interlinked with the power generation coil 13 and FIG. 6(L) is a view showing an example of the progress of the induced electromagnetic force 43-1 generated by the power generation coil 23.

In the method for producing electricity using the induced electromagnetic force of a power generation coil according to the present invention, as shown in FIG. 2(A), an excitation core 12 is constructed by providing a magnetic force guidance unit 31 configured to form a closed circuit and to absorb magnetic force 41 generated from the excitation coil 11 and form lines of magnetic force and then winding the excitation coil 11 configured to receive electricity and produce magnetic force and the power generation coil 13 configured to produce electricity on both sides of the magnetic force guidance unit, thereby absorbing the magnetic force produced from the excitation coil, forming lines of magnetic force 41 and interlinking magnetic force with the power generation coil.

As shown in FIG. 2(B), each of the power generation cores 22 is constructed by providing a magnetic force guidance unit 31-1 configured to form a closed circuit and to absorb the induced electromagnetic force produced from the power generation coils 13 and 23 and form lines of magnetic force and then winding a power generation coil 23 on one side of the magnetic force guidance unit.

As shown in FIGS. 3(C) and 3(D), a power generation cell 52 is constructed by stacking the magnetic force guidance units 31-1 of the power generation cores 22 on the power generation coil 13 of the excitation core 12 disposed first and then stacking the magnetic force guidance units 31-1 of the power generation cores 22 on the stacked power generation coils 23 of the power generation cores 22.

As shown in FIGS. 4(E) and 4(F), a power generation module 53 is constructed by combining a specific number of power generation cells 52 which can output a designed amount of electricity.

A controller 50 is provided to connect the power generation coil of the power generation module and controls the input and output of electricity and operation.

As shown in FIG. 1, the components are accommodated and held in a housing 50.

The operation of the "method for producing electricity using the induced electromagnetic force of a power generation coil" according to the present invention, which is configured as described above, will be described below.

First, when an alternating current or a direct current repeating connection and disconnection is applied by the controller 50, a magnetic force 41 which changes as shown in FIG. 5(G) is generated in the excitation coil 11 of the excitation core 12, the generated magnetic force forms a magnetic force line 41 in the magnetic force guidance unit 31, and the induced electromagnetic force 43 induced by the electric current of electricity interlinked through the center of the power generation coil 13 wound on one surface of the magnetic force guidance unit is generated in the power generation coil.

In this case, as shown in FIGS. 5(G) and 5(H), the magnetic force 41 generated from the excitation coil forms a magnetic force tangent 44 in which N and S poles are symmetrical to the center of the excitation coil and the magnetic force guidance unit 31, forms the magnetic force 41 on the magnetic force guidance unit 31, and proceeds in opposite directions depending on its polarity.

The lines of magnetic force proceeding in different directions forms an opposite or another magnetic force tangent 44-1 in the symmetric plane of the magnetic force tangent 44 of the magnetic force conductor 31 because the magnetic force conductor 31 constitutes a closed circuit, as shown in FIGS. 5(G) and 5(H).

When the power generation coil 13 is disposed by being wound at both ends around the magnetic force line 44-1, as shown in FIG. 5(G), and electricity is applied, the magnetic force produced in the excitation coil 11 enters both ends of the power generation coil and is interlinked with the power generation coil 13, so that electricity is produced in the power generation coil and simultaneously the induced electromagnetic force 43 is generated.

In this case, when magnetic force passes through the hollow of the power generation coil, electricity and induced electromagnetic force are produced from the power generation coil. The produced induced electromagnetic force is formed as magnetic force having the same polarity as the magnetic force entering the power generation coil for interlinkage on the cross section of the power coil where the magnetic force enters according to the "Lenz's law" and acts as repulsive resistance which impedes the progress of the magnetic force. As a result, the loss of magnetic force occurs, and thus power generation efficiency of the power generation coil is reduced.

Therefore, according to the method for producing electricity using the induced electromagnetic force of a power generation coil according to the present invention, the magnetic force guidance unit 31-1 is stacked on the power generation coil 13, as shown in FIG. 3(D).

Accordingly, the induced electromagnetic force 43 generated by the power generation coil is absorbed into the magnetic force guidance unit 31-1, and has a proceeding trajectory different from that of the magnetic force 41 produced from the excitation coil 11 are obtained, as shown in FIG. 6(K). As a result, a mutual collision does not occur, and thus repulsive resistance is prevented from occurring.

In this case, the magnetic force guidance unit in which a line of magnetic force line interlinked with the power generation coil is formed absorbs the magnetic force and reaches a saturated state. The magnetic force guidance unit stacked on the power generation coil has an empty magnetic path space in which lines of internal magnetic force are formed, and thus the induced electromagnetic force produced by the power generation coil is rapidly absorbed into the magnetic induction conductor and forms a magnetic flux inside the magnetic induction conductor.

Furthermore, since the greatest magnetic force is formed at an end of an object forming a line of magnetic force, i.e., an end cross section of the magnetic force induction conductor, the greatest attraction force or repulsive force is generated when cross section having polarities face each other. However, since there is no end cross section because the magnetic force guidance unit constitutes a closed circuit and the line of magnetic force proceeding to be interlinked with the power generation coil and the induced electromagnetic force produced by the power generation coil do not face each other because the inductors forming the lines of magnetic force are different and proceeding paths are different, there is no collision between them.

In this case, it will be apparent that the controller 50 selectively allows and blocks the input and output of electricity, controls them, and supplies a specific amount of electricity which allows the excitation coil 11 to produce and supply the magnetic force sufficient to enable the magnetic force guidance unit 31 to reach a saturated point.

By the above-described method, electricity is produced by using the induced electromagnetic force of the excitation core as power generation magnetic force interlinked with the power generation coil without power generation resistance, electricity and induced electromagnetic force are produced by interlinking the induced electromagnetic force, generated as electricity is produced, with the power generation coil, and electricity is produced by using the induced electromagnetic force generated from the power generation coil of the power generation core disposed first as the power generation magnetic force of the power generation core disposed later.

DESCRIPTION OF REFERENCE SYMBOLS

11: excitation coil 12: excitation core 13: power generation coil
22: power generation core 23: power generation coil
31: magnetic force guidance unit 31-1: magnetic force guidance unit
41: magnetic force 41-1: magnetic force 43: induced electromagnetic force
43-1: induced electromagnetic force 44: magnetic force tangent 44-1: magnetic force tangent
45: magnetic force tangent 45-1: magnetic force tangent
50: controller 51: housing 52: power generation cell
53: power generation module

INDUSTRIAL APPLICABILITY

The "method for producing electricity using the induced electromagnetic force of a power generation coil" according to the present invention has high energy usage efficiency because it has no energy loss attributable to energy conversion and no energy loss attributable to the resistance of induced electromagnetic force, does not cause contamination such as a harmful material, noise, etc. because it has no energy conversion device, and may be used for the production of electricity easy to manage because it has a simple structure.

The invention claimed is:

1. A method for producing electricity using induced electromagnetic force of a power generation coil, the method producing electricity by interlinking (passing) varying magnetic force with (through) a power generation coil, the method comprising:

an excitation core (12) which produces electricity and induced electromagnetic force by using magnetic force produced using input electricity;

power generation cores (22) which produce electricity and induced electromagnetic force by using induced electromagnetic force; and a controller (40) which controls and manipulates input and output of electricity; and a housing (51) which accommodates and holds components;

wherein electricity is produced by interlinking induced electromagnetic force, which is generated from a power generation coil when electricity is produced, with a power generation coil disposed later through guidance using a magnetic force guidance unit.

2. The method of claim 1, wherein each of the power generation cores (22) is constructed by providing a magnetic force guidance unit (31-1) configured to form a closed circuit and to absorb and induce induced electromagnetic force and winding a power generation coil (23) on one side of the magnetic force guidance unit, as shown in FIG. 2(B).

3. The method of claim 1, wherein a power generation cell is constructed by stacking a magnetic force guidance unit of a first power generation core of the power generation cores on a power generation coil of the excitation core and then stacking a magnetic force guidance unit of a second power generation core of the power generation cores on a power generation coil of the first power generation core disposed first.

4. The method of claim 1, wherein a power generation module is constructed by combining a plurality of power generation cells corresponding to a design desired capacity.

* * * * *